US011826761B2

(12) United States Patent
Meyer et al.

(10) Patent No.: US 11,826,761 B2
(45) Date of Patent: Nov. 28, 2023

(54) HIGH-PRESSURE PUMP

(71) Applicant: Kleemann GmbH, Göppingen (DE)

(72) Inventors: Gerd Meyer, Amstetten (DE); Rainer Teichert, Haan (DE); Jochen Meier, Hülben (DE); Till Krauss, Göppingen-Faurndau (DE)

(73) Assignee: KLEEMANN GMBH

( * ) Notice: Subject to any disclaimer, the term of this patent is extended or adjusted under 35 U.S.C. 154(b) by 497 days.

(21) Appl. No.: 17/045,872

(22) PCT Filed: Apr. 11, 2019

(86) PCT No.: PCT/EP2019/059215
§ 371 (c)(1),
(2) Date: Oct. 7, 2020

(87) PCT Pub. No.: WO2019/206653
PCT Pub. Date: Oct. 31, 2019

(65) Prior Publication Data

US 2021/0039107 A1 Feb. 11, 2021

(30) Foreign Application Priority Data

Apr. 27, 2018 (DE) ..... 10 2018 110 267.4

(51) Int. Cl.
*B02C 1/00* (2006.01)
*B02C 1/02* (2006.01)
(Continued)

(52) U.S. Cl.
CPC ..... *B02C 1/025* (2013.01); *B02C 25/00* (2013.01); *B02C 1/005* (2013.01); *B02C 1/04* (2013.01)

(58) Field of Classification Search
CPC ..... B02C 1/025; B02C 1/04; B02C 1/005
See application file for complete search history.

(56) References Cited

U.S. PATENT DOCUMENTS 2,636,690 A 4/1953 Roubal
4,765,546 A * 8/1988 Stewart ..... B02C 1/005 241/266

(Continued)

FOREIGN PATENT DOCUMENTS

AT 239635 B 4/1965
DE 102010015583 A1 10/2011

(Continued)

OTHER PUBLICATIONS

International Search Report for patent application No. PCT/EP2019/059215, dated Jun. 27, 2019, 10 pages (not prior art).

(Continued)

*Primary Examiner* — Faye Francis
(74) *Attorney, Agent, or Firm* — Lucian Wayne Beavers; Patterson Intellectual Property Law, PC

(57) ABSTRACT

A high-pressure pump for the overload protection of a jaw crusher, with an actuator unit which adjustably receives an actuation element in a housing, wherein the actuation element has at least one piston, wherein at least one actuator, tensioning cylinder and a pressure accumulator are provided, wherein the actuator unit is in fluid-conveying connection with the actuator such that in one pump stroke of the actuator unit a transfer fluid is pumped into a second chamber of the actuator and of the tensioning cylinder and the quantity of transfer medium displaced from the actuator, and the tensioning cylinder during the pump stroke is temporarily stored in a pressure accumulator.

19 Claims, 10 Drawing Sheets

Figure 1:
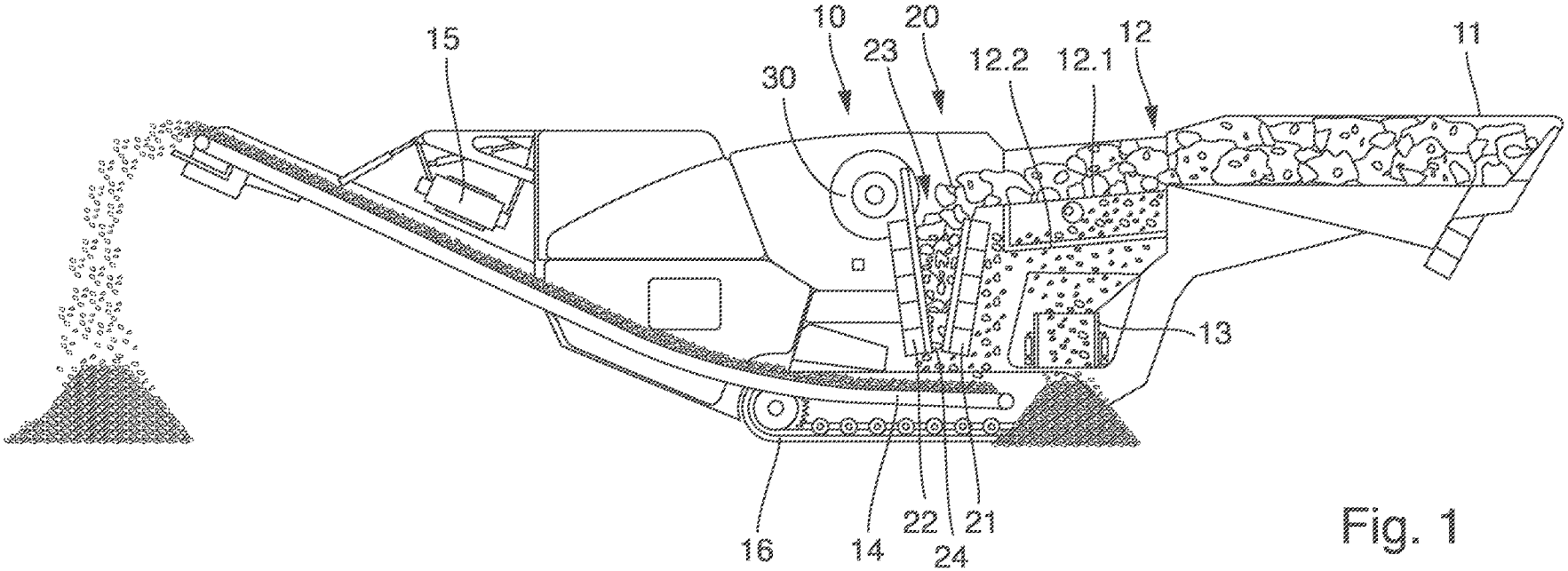

(51) Int. Cl.
*B02C 25/00* (2006.01)
*B02C 1/04* (2006.01)

(56) References Cited

U.S. PATENT DOCUMENTS 5,660,337 A * 8/1997 Falbo ..... B02C 1/025 241/264
5,725,166 A * 3/1998 Nakayama ..... B02C 1/04 241/267
7,614,573 B1 * 11/2009 Jean ..... B02C 1/04 241/269
8,925,171 B2 * 1/2015 Eriksson ..... B02C 1/025 29/278
9,295,991 B2 * 3/2016 Hartl ..... B02C 1/04
9,421,547 B2 8/2016 Boast et al.
2004/0129814 A1 * 7/2004 Ha ..... B02C 1/005 241/267
2015/0107232 A1 * 4/2015 Burhoff ..... B02C 1/025 241/32
2015/0224508 A1 * 8/2015 Jonkka ..... B02C 1/025 241/32
2015/0238970 A1 * 8/2015 Nakayama ..... B02C 1/04 241/264
2021/0239144 A1 * 8/2021 Gnam ..... B02C 25/00

FOREIGN PATENT DOCUMENTS

DE 102013210016 A1 12/2013
DE 102015118398 A1 1/2016
EP 2135677 A1 12/2009
EP 2662142 A1 11/2013
JP 2006247602 A 9/2006
KR 101685177 B1 12/2016

OTHER PUBLICATIONS

Co-pending U.S. Appl. No. 17/045,866, filed Oct. 7, 2020, 33 pages (not prior art).
India Office Action for corresponding patent application No. 202047046093, dated Apr. 21, 2022, 6 pages.

* cited by examiner

HIGH-PRESSURE PUMP

The control unit 60 is used to adjust the crushing gap 24 between the two crusher jaws 21, 22. The control unit 60 may also be referred to as an adjustable support 60 configured to provide relative movement between the crusher jaws to adjust the crushing gap.

The invention relates to a high-pressure pump for the overload protection of a crusher unit of a crusher, in particular of a jaw crusher.

Jaw crushers of the type mentioned above are used for crushing rock material, such as natural stone, concrete, bricks or recycled material. The material to be crushed is fed to a feed unit of the material crusher plant, for instance in the form of a hopper, and fed to the crusher unit via transport devices. In a jaw crusher, two crusher jaws arranged at an angle to each other form a wedge-shaped shaft into which the material to be crushed is introduced. While one crusher jaw is stationary, the opposite crusher jaw can be moved by means of an eccentric and is supported by a pressure plate on a control unit. The latter is articulated in relation to the swingarm holding the movable crusher jaw and the actuator unit. This results in an elliptical motion of the movable crusher jaw, which crushes the material to be crushed and guides it downwards in the shaft into a crushing gap. A control unit can be used to adjust the gap width of the crushing gap.

The crusher is exposed to high mechanical loads during the crushing process. These result from the feed size, the grain distribution and the crush resistance of the fed material and from the desired crushing ratio and the filling level of the material to be crushed in the crushing chamber of the crusher. Incorrect operation of the material crusher plant, in particular if a non-crushable element, e.g. a steel element, enters the crushing chamber, can result in an overload of the crusher. This can damage or wear out components of the crusher prematurely.

In the event of an overload, the pressure plate can also serve as a predetermined breaking point. If a non-breakable object in the crushing chamber blocks the crusher jaws, the forces acting on the movable crusher jaw increase. These forces are transferred into the pressure plate. If the forces are excessive, the pressure plate buckles. This causes the movable crusher jaw to move out of the way and the crushing gap to increase. In this way the unbreakable object can then fall out of the crushing chamber. This reliably prevents damage to important system components of the jaw crusher. Clearly this procedure can only be used sensibly if the frequency of foreign elements entering the crushing chamber is very low because the pressure plate is damaged every time. Therefore, ways to avoid damage to the pressure plate based on the state of the art were sought. For this reason, EP 2 662 142 B1 proposes a jaw crusher, in which the moving crusher jaw is again supported by a pressure plate. The pressure plate itself is supported by a hydraulic cylinder on its side facing away from the movable crusher jaw. A high-pressure valve is assigned to the hydraulic cylinder. If an overload situation now occurs, the valve opens and the hydraulic cylinder is triggered. Then the movable crusher jaw can move out of the way, which increases the crushing gap. The disadvantage of this design is that the hydraulic cylinder no longer provides rigid support for the moving crusher jaw during the crushing process. The hydraulic cylinder brings too much elasticity into the system affecting the crushing result.

The invention addresses the problem of providing a means of effectively acting on the support system of the crusher jaws in the event of an overload to permit the uncrushable or difficult to crush object to escape from the crushing jaws by letting the crusher jaws move away from each other.

This problem is solved by the high-pressure pump in accordance with claim 1. Accordingly, the high-pressure pump for the overload protection of a crusher unit has an actuator unit, which adjustably accommodates an actuation element in a housing. The actuation element has at least one piston or it is coupled to at least one piston. Furthermore, at least one actuator and one pressure accumulator are provided. The actuator unit is connected in a fluid-conveying manner to the actuator such that in a pump stroke of the actuator unit a transfer medium is pumped into a second chamber of the actuator and during the pump stroke a quantity of transfer medium displaced from a further first chamber of the actuator is temporarily stored in a pressure accumulator. Hydraulic oil can be the preferred transfer medium in such a case. Such a high-pressure pump can be used to act on one or several actuators of the crusher unit. For instance, it may, in particular, be used to pressurize an actuator, which, in conjunction with an actuator unit of the jaw crusher, opens the crushing jaw of the jaw crusher when a non-crushable object enters the crushing jaw. The invention may also comprise one or more actuators to assist in the opening motion of the crushing jaw. For instance, an actuator designed as a tensioning cylinder can be supplied by the high-pressure pump, wherein the tensioning cylinder preloads a pressure plate during the opening movement. The high-pressure pump according to the invention can be integrated into an at least partially closed fluid circuit, which effectively supports a simple design.

For this purpose it may also be provided that in a return stroke of the actuator unit, the pressure accumulator conveys the transfer medium to the pump chamber of the actuator unit.

If provision is made that the first chamber of the actuator has at least the same cross-sectional area as the second chamber of the actuator, the pump chamber supplying the actuator is always completely filled with transfer medium.

In a preferred variant of the invention, the actuator unit can be blocked in a rest position and after the actuator unit has been released, it is in a position from which it is ready to perform the pump stroke. This can be implemented in a simple manner, for instance, by blocking the actuator unit in the rest position by pressurizing transfer medium in a chamber, in particular in a pump chamber designed as a blocking chamber.

To be able to implement a closed circuit system, a variant of the invention provides that the pump chambers are interconnected in such a way that during the pump stroke the blocking chamber is supplied from the actuator by a return quantity of the transfer medium and in the return stroke the blocking chamber delivers transfer medium to a further pump chamber.

According to a preferred variant of invention it may be provided that a deflector element is provided, which is designed to drive the actuator unit, and that in the rest position of the actuation element, a possible contact between the deflector element and the actuation element or the parts attached thereto is avoided. The actuation element can, for example, be adjusted by a deflector element attached to a drive shaft. The drive shaft can be part of the crusher drive, resulting in high forces being available to operate the high-pressure pump. This makes for a particularly effective crushing gap adjustment. In this way, wear can be optimized by connecting a connection piece to the actuation element, which holds a rolling element outside the housing. The rolling element can, for instance, run along a radial cam to adjust the actuation element.

A particularly preferred variant of invention is such that the pressure accumulator has a housing, in which a piston can be adjusted against the pretension of a spring and that transfer medium in the housing can be pressurized by means of the piston and the spring. Such pressure accumulators are of simple design and have no or only minor approval requirements. In this respect, they offer advantages over conventional gas accumulators.

The actuation element has a simple and pressure-stable design, if it is provided that the pistons are coaxially interconnected in the pumping direction, in particular integrally interconnected.

For the high-pressure pump, a simple design results if provision is made that a piston of the actuation element has two active sides arranged opposite from each other and that each active side is assigned to a pumping chamber.

It is conceivable to use the high-pressure pump in systems where different types of actuators are used. To be able to meet the different needs of these actuators, provision may be made that when the pistons are adjusted during the pump stroke, different volumes of a transfer medium are delivered from the pump chambers and/or that different pressures are generated in the pump chambers during the pump stroke.

Figure 2:
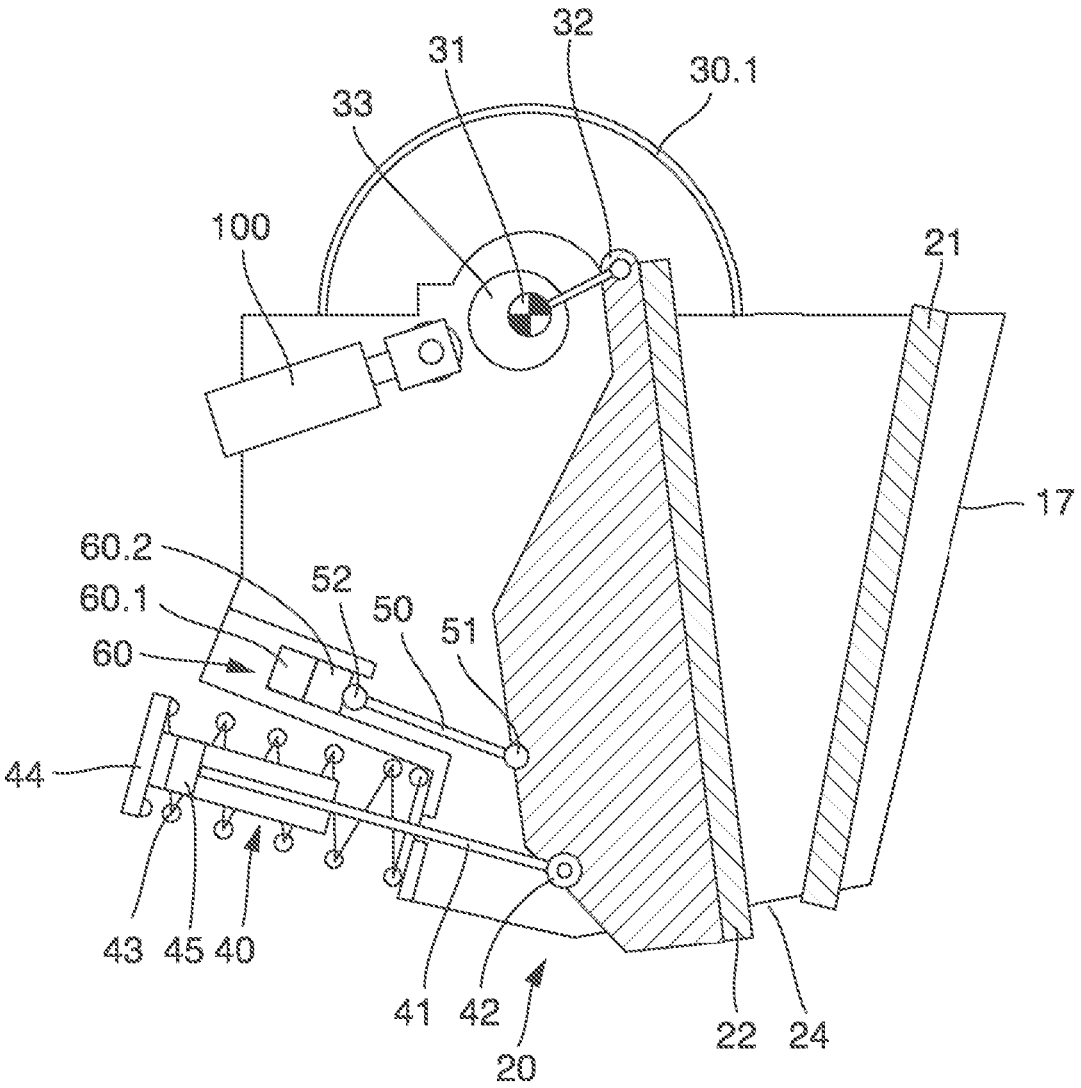
Figure 3:
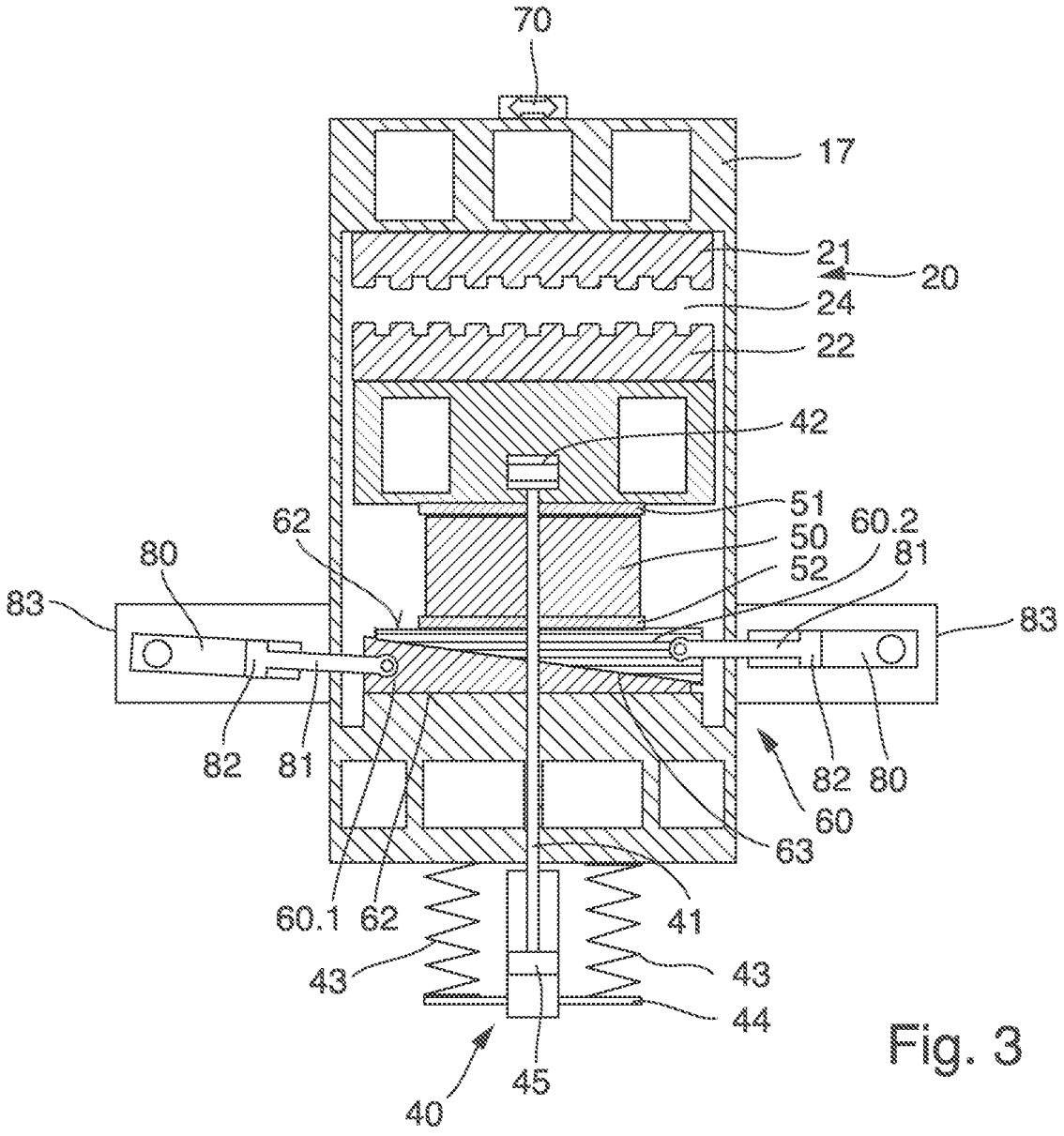
Figure 4:
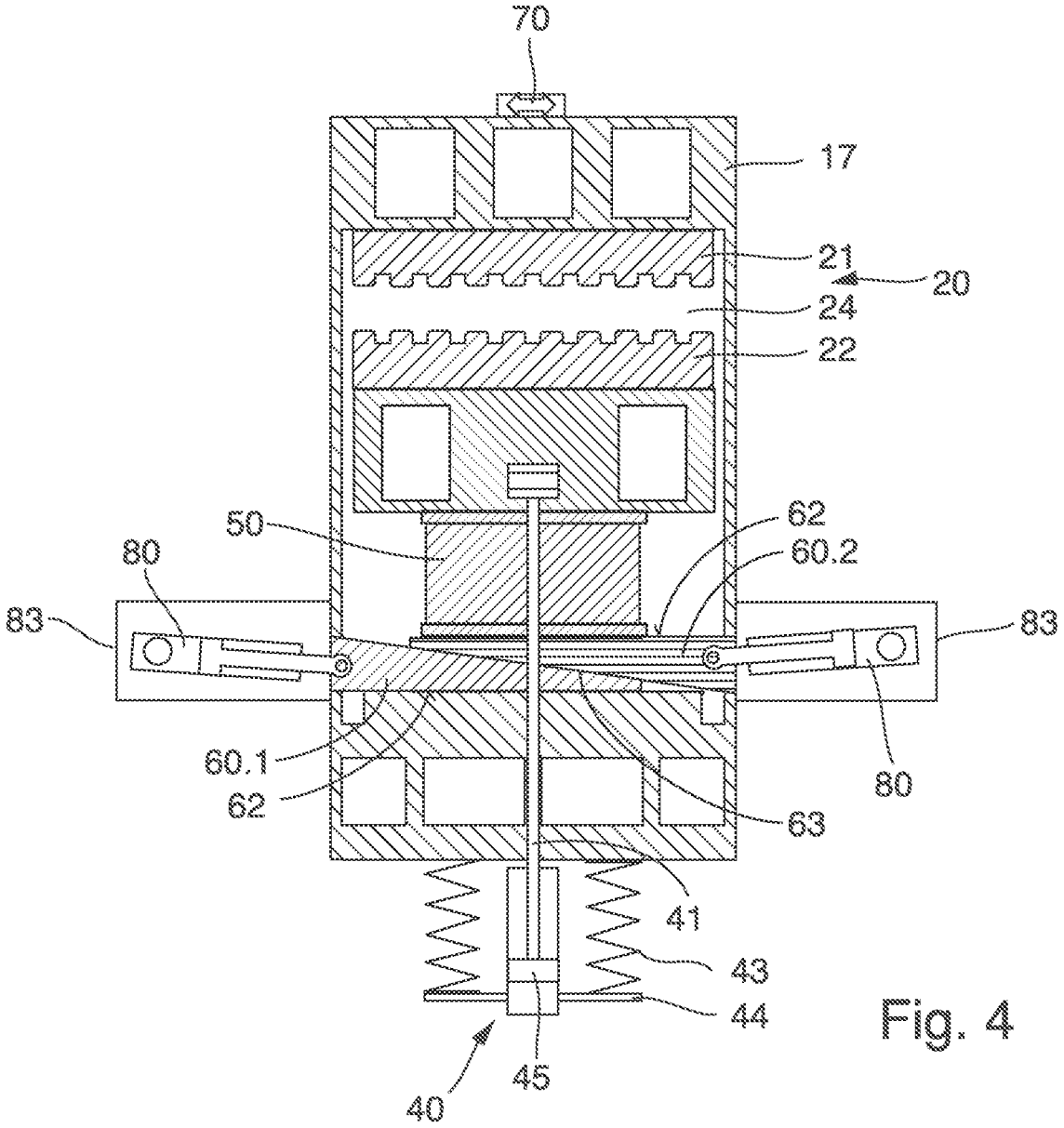
Figure 5:
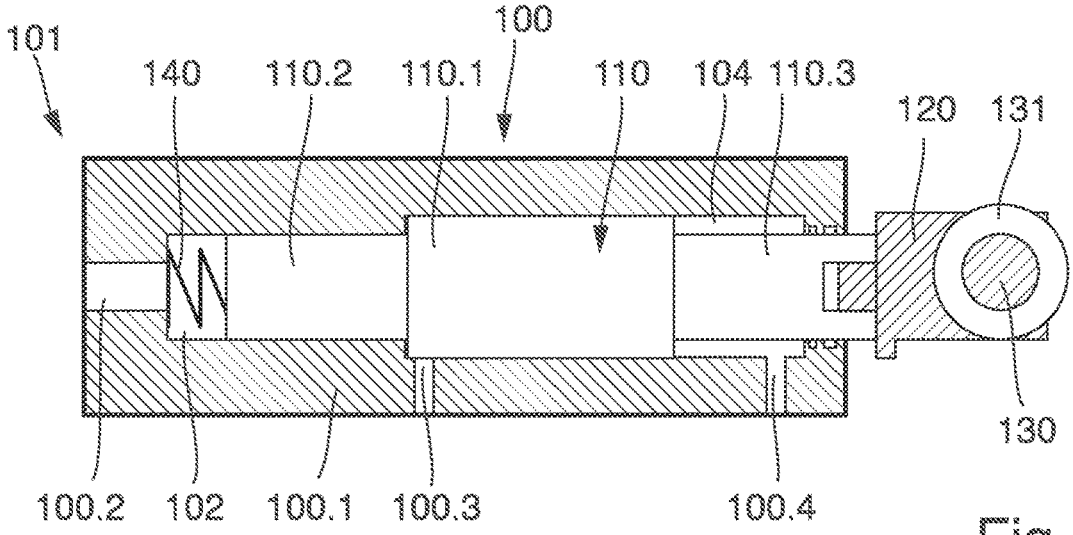
Figure 6:
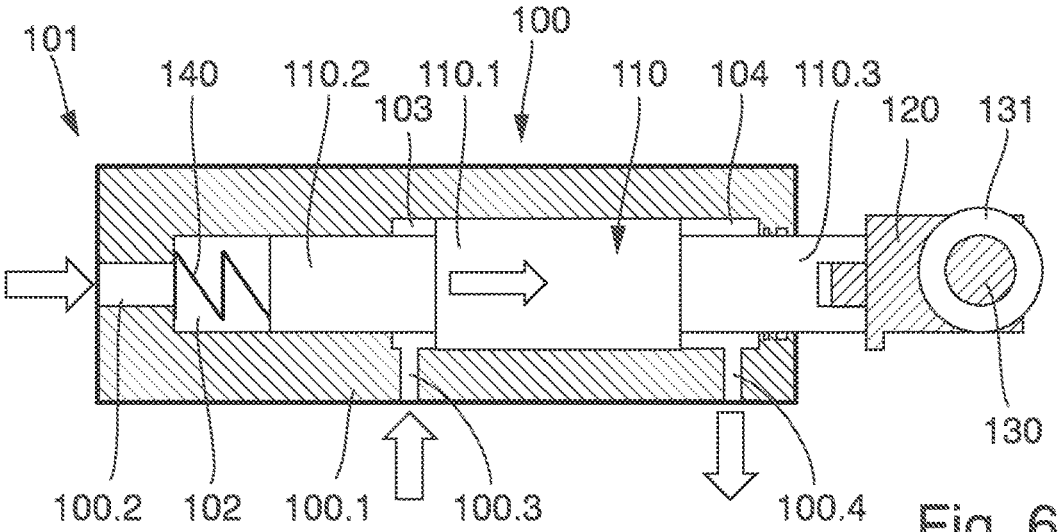
Figure 7:
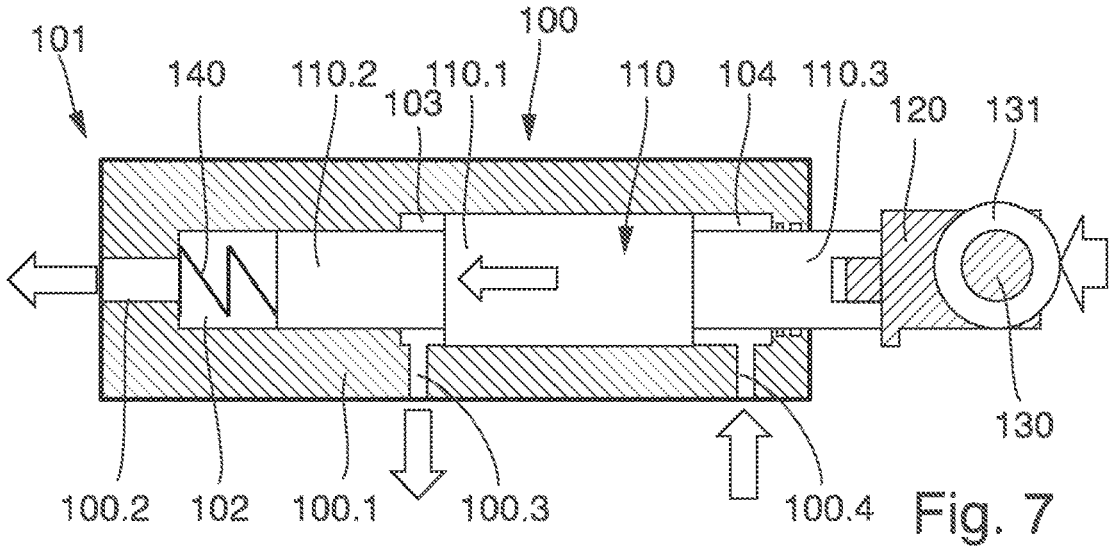

The invention is explained in greater detail below based on an exemplary embodiment shown in the drawings. In the Figures:

FIG. 1 shows a schematic side view of a crusher,

FIG. 2 shows a side view and a schematic diagram of a crusher unit of the crusher of FIG. 1, FIG. 3 shows a schematic diagram of the crusher unit of FIG. 2 in a view from below onto the crushing gap and in a first operating position, FIG. 4 shows the representation in accordance with FIG. 3 in a different operating position, FIGS. 5 to 7 show an actuator unit in various operating positions and FIGS. 8 to 12 show hydraulic circuit diagrams.

FIG. 1 shows a crusher 10, in this case a movable jaw crusher. This crusher 10 has a feed hopper 11. An excavator, for instance, can be used to load the crusher 10 with rock material to be crushed in the area of the feed hopper 11. A screening unit 12 is provided directly downstream of the feed hopper 11. The screening unit 12 has at least one screen deck 12.1, 12.2. In this exemplary embodiment two screen decks 12.1, 12.2 are used. The first screen deck 12.1 can be used to screen out a grain fraction of the material to be crushed, which has a suitable size to begin with. This partial flow does not have to be routed through the crusher unit 20. Rather, it is routed past the crusher unit 20 in the bypass so as not to stress the crusher unit 20. On the second screen deck 12.2, a finer grain fraction is again screened out of the previously screened partial fraction. This so-called fine grain can then be discharged via a lateral belt 13, which is formed, for instance, by an endlessly circulating conveyor.

The material flow not screened out on the first screen deck 12.1 is fed into the crusher unit 20. The crusher unit 20 has a stationary crusher jaw 21 and a movable crusher jaw 22. A crushing chamber 23 is formed between the two crusher jaws 21, 22. At their lower ends, the two crusher jaws 21, 22 define a crushing gap 24. The two crusher jaws 21, 22 thus form a crushing chamber 23 converging towards the crushing gap 24. The stationary crusher jaw 21 is firmly mounted to the crusher frame 17. An eccentric drive 30 drives the movable crusher jaw 22. The crusher drive 30 has a drive shaft 31, on which a flywheel 30.1 is mounted for co-rotation. This will be explained in more detail below. As FIG. 1 further shows, the crusher has a crusher discharge conveyor 14 below the crushing gap 24 of the crusher unit 20. Both the screenings that pass the crusher unit 20 in the bypass, which screening was screened out on the first screen deck 12.1, and the rock material crushed in the crushing chamber fall onto the crusher discharge conveyor 14. The crusher discharge conveyor 14 conveys this rock material out of the working area of the machine and transports it to a rock pile. As FIG. 1 shows, a magnet 15 may be used, which is located in an area above the crusher discharge conveyor 14. The magnet 15 can be used to lift ferrous parts out of the transported material to be crushed.

Finally, FIG. 1 shows that the present crusher 10 is a movable crusher. It has a machine chassis that is supported by two undercarriages 16, in particular two crawler track units. Of course, the invention is not limited to the use in movable crushers. The use in stationary systems is also conceivable.

FIG. 2 shows schematic side view of the kinematic structure of the crusher unit 20 in more detail. The stationary crusher jaw 21 and the movable crusher jaw 22 are clearly visible in this illustration. The movable crusher jaw 22 can, as shown here, be designed in the form of a swing jaw. It has a bearing point at the top, which is used to connect it to the drive shaft 31, rotatably mounted. The drive shaft 31 is on the one hand rotatably mounted on the crusher frame 17 and on the other hand rotatably supported in a bearing 32 of the movable crusher jaw 22 with the eccentric part of the drive shaft, for instance a lever. A flywheel 30.1 having a large mass is coupled to the drive shaft 31 for co-rotation. The drive shaft 31 itself is eccentrically designed. I.e., when the drive shaft 31 rotates, the movable crusher jaw 22 also performs a wobbling circular motion following the eccentric motion. A pressure plate 50 is provided in the area of the free end of the movable crusher jaw 22. A pressure plate bearing 51 supports the pressure plate 50 on the movable crusher jaw 22. A further pressure plate bearing 52 supports the pressure plate 50 on a control unit 60.

The control unit 60 is used to adjust the crushing gap 24 between the two crusher jaws 21, 22.

A tensioning cylinder 40 is provided in order to be able to maintain a defined allocation of the pressure plate 50 to the control unit 60 on the one hand and to the movable crusher jaw 22 on the other hand during the crushing process. The tensioning cylinder 40 has a piston rod 41, which bears a fastening element 42 at one end. The fastening element 42 is pivotably attached to the movable crusher jaw 22. The piston rod 41 is connected to a piston 45. The piston 45 can be linearly adjusted in the tensioning cylinder 40. A beam 44 bears the housing of tensioning cylinder 40. The beam 44 is supported by at least one, preferably two, compression springs 43 on a component of the crusher frame 17. A spring preload is applied accordingly. The spring preload causes a tension, which pulls the housing of the tensioning cylinder 40 and with the latter the piston 45 and the piston rod 41. In this way a tensioning force is applied to the movable crusher jaw 22, which tensioning force is transferred to the pressure plate 50. Accordingly, the pressure plate 50 is held in a clamped and preloaded manner between the movable crusher jaw 22 and the control unit 60.

FIG. 3 shows that the pressure plate 50 is held between the two pressure plate bearings 51, 52. In this exemplary embodiment, the control unit 60 has, among other things, two control elements 60.1, 60.2, which can be designed in the form of adjustment wedges as in this case. The wedge surfaces 63 of the adjustment wedges are placed in contact with each other. The adjusting wedges are designed such that in the assembled state, i.e. when the wedge surfaces 63 are in contact with each other, the opposite supporting surfaces 62 of the adjusting wedges 60.1, 60.2 are mainly parallel to each other. Adjusting wedges 60.1, 60.2 may also be referred to as first and second adjustment elements 60.1 and 60.2.

As FIGS. 3 and 4 show, each control element 60.1, 60.2 is assigned to an actuator 80. The actuators 80 are preferably of identical design. The actuators 80 can be designed as hydraulic cylinders. The actuators 80 have a coupling 81. This coupling 81 is used to connect them to their assigned control elements 60.1, 60.2. A piston 82 is coupled to the coupling 81, which can be guided in a cylinder housing of the actuator 80 as a result of a displacement of a hydraulic fluid. Brackets 83 are used to attach the actuators 80. These brackets 83 are used to connect the actuators 80 to the crusher frame 17.

According to a preferred invention variant, the actuators 80 act bidirectionally. They are used to allow the adjustment of the crushing gap 24 during normal crushing operation. Accordingly, they can be controlled via a controller, for instance. Because both actuators 80 are permanently coupled to the control elements 60.1, 60.2, the control elements 60.1, 60.2 can be moved linearly with the actuators 80. The gap width of the crushing gap 24 is determined depending on the control position of the control elements 60.1, 60.2. The tensioning cylinder 40 follows the adjustment motion, i.e. it is guaranteed that the pressure plate 50 is always held securely between the two pressure plate bearings 51, 52.

While a small crushing gap 24 is set in FIG. 3, a large crushing gap 24 is set in FIG. 4.

As FIGS. 3 and 4 further show, the stationary crusher jaw 21 is supported by the crusher frame 17. In the area behind the stationary crusher jaw 21, a load sensor 70 is attached to the crusher frame 17. The load sensor 70 measures the elongation of the crusher frame 17 in the area where the load sensor 70 is attached. Of course, the load sensor 70 can also be attached at another suitable place on crusher frame 17. It is also conceivable that the load sensor 70 is assigned to one of the two crusher jaws 21, 22 or to another highly stressed machine component in crushing operation.

As the illustration in FIG. 2 shows, an additional deflector element 33 is arranged on the drive shaft 31 for co-rotation. The deflector element 33 can, for instance, be formed by a disk-shaped element, in this case a cam disk. The circumference of the disk-shaped element forms a radial cam. The cam disk may also be referred to as a cam lobe.

FIG. 2 further shows that an actuator unit 100 is assigned to the crusher unit 20. The design of the actuator unit 100 will be explained in more detail below, with reference to FIGS. 5 to 7. The actuator unit 100 may also be referred to as an actuator power supply 100 or as a high-pressure pump 100.

FIGS. 5 to 7 show the actuator unit 100 of the invention in more detail. As this illustration shows, the actuator unit 100 has a housing 101. The housing 101 can form at least one, in this exemplary embodiment preferably three, pump chamber(s) 102, 103 and 104. Every pump chamber 102, 103 and 104 is equipped with a fluid port 100.2, 100.3, 100.4. An actuation element 110 is supported in the housing 100.1. The actuation element 110 may also be referred to as a pump actuation element 110.

The actuation element 110 can be linearly adjusted in the housing 100.1. The actuation element 110 has a first piston 110.1 and a second piston 110.2. Embodiments, in which only one piston 110.1 is used, are also conceivable. The first piston 110.1 has a relatively smaller diameter than the second piston 110.2.

A connection piece 110.3 is connected to the second piston 110.1. The connection piece 110.3 is used to guide the actuation element 110 out of the housing 100.1, the connection piece 110.3 bears a head 120. A rolling element 130 is connected to the head 120 for rotation. The rolling element 130 can have the shape of a wheel, as shown here. The rolling element 130 has an outer circumferential running surface 131. The rolling element 130 may also be referred to as a roller 130.

As the drawings show, the actuation element 110 is supported in the housing 100.1 against the preload of a spring 140. The spring 140 acts on the actuation element 110 preferably in the area of one of the pistons 110.1, 110.2 and can be accommodated in a space-saving manner in one of the pump chambers, preferably in the first pump chamber 102.

The actuator unit 100 is spatially assigned to the deflector element 33 (see FIG. 2). The rolling element 130 is designed to roll on a radial cam of the deflector element 33 when it rotates in conjunction with the drive shaft 31.

FIG. 5 shows the actuator unit 100 in its initial position. The jaw crusher operates normally. There are no overload situations. In this state, the fluid port 100.4 is used to apply a control pressure to the pump chamber 104. This control pressure blocks the actuation element 110 in the position shown in FIG. 5, and accordingly the pump chamber 104 may be described as a blocking chamber 104. The spring 114 exerts a spring preload on the actuation element 110 against the pressure in the pump chamber 104.

If an overload occurs, the operating position as shown in FIG. 6 results. Accordingly, the actuation element 110 is extended. For this purpose the control pressure is removed from the pump chamber 104. The fluid is diverted from the pump chamber 104 to the second pump chamber 103 via a fluid-conveying connection. The spring 140 can relax, causing the actuation element 110 to be extended. In the plane of the image shown in FIG. 6, the actuation element 110 is therefore moved to the right. Additionally or alternatively, the fluid port 100.2 can be used to apply pressure to the actuation element 110 to move it to its extended position. This pressure can preferably be used to pressurize the fluid port 100.2 such that the pressure also acts in the first pump chamber 102. Accordingly, this pressure causes or supports the extension of the actuation element 110. When the actuation element 110 is extended, the rolling element 130 is in contact with the radial cam. When the drive shaft 31 and with it the radial cam rotates, the rolling element 130 rolls on the radial cam. Accordingly, the rolling element 130 follows the contour of the radial cam. As soon as the rolling element 130 drives against the deflector element 33, the situation is as shown in FIG. 7. Then a force F acts on the rolling element 130. This is the force induced by the kinetic energy of the moving parts of the jaw crusher and the crusher jaw drive. The force can gain a considerable amount of force simply from the high kinetic energy available in the system due to the heavy moving masses (moving crusher jaw 22, flywheel 30.1). Accordingly, a particularly high force can be made available at the actuation element 110. The deflector element 33 thus pushes the actuation element 110 from the position shown in FIG. 6 into the housing 100.1. In so doing, the first piston 110.1 displaces the hydraulic fluid in the second pump chamber 103. Simultaneously, the piston 110.2 displaces the hydraulic fluid in the first pump chamber 102. The hydraulic fluid in the pump chamber 103 is routed to the tensioning cylinder 40. The hydraulic fluid in the pump chamber 102 is routed to the actuator 80. As a result, both the tensioning cylinder 40 and the actuator 80, which are both designed as hydraulic cylinders, are adjusted.

As mentioned above, it is advantageous if not only one actuator 80, but both actuators 80 are adjusted simultaneously. In this way, the crushing gap 24 can be enlarged within a very short time. In this case, both actuators 80 are connected to the first pump chamber 102.

As a result of an adjustment of the two actuators 80, the two control elements 60.1 and 60.2 are displaced relative to each other. Consequently, the movable crusher jaw 22 can move out of the way, increasing the crushing gap 24. The tensioning cylinder 40 is activated to prevent the pressure plate 50 from falling down, as mentioned above. The tensioning cylinder 40 pulls the movable crusher jaw 22 against the pressure plate 50 to keep the latter always tensioned.

In particular, it may be preferable to have the actuator(s) 80 of the actuator unit 100 pressurized two or more times within one overload cycle to open the crushing gap 24. Then the actuator unit can be designed having a relatively manageable installed size. For instance, it may be intended that the actuation element 110 of the actuator unit 100 described above performs two or more pump strokes. The actuator 80 and/or the tensioning cylinder 40 is/are in such a case not moved along its/their entire length of travel per pump stroke, but only along a partial length of travel. After the deflector element 33 is attached to the drive shaft 31, the pump strokes can be performed in short succession, one after the other, enabling the crushing gap 24 to be opened quickly.

It is also conceivable that the invention could be designed in such a way that the deflector element 33 is designed such that two or more pump strokes can be achieved per revolution. Similarly, a configuration of the invention is conceivable in which two or more actuator units are used, all of which act on the actuators simultaneously or with a time delay.

The position of the deflector element 33 on the drive shaft 31 determines the point at which the pumping action of the actuator unit 100 is initiated. The deflector element 33, which operates the rolling element 130, is arranged at an angular offset to the eccentric, which is responsible for the eccentric motion of the movable crusher jaw 22. Because of the angular offset, the opening motion of the control unit 60 can be synchronized with the motion of the moving crusher jaw. Particularly preferably, the deflector element 33 is set in such a way that the opening motion of the crushing gap 24 by the control unit 60 begins shortly before the closing motion of the crushing gap 24, which is performed by the rotation of the drive unit of the crusher. This prevents uncrushable material from being further pressed in the crusher jaw and reduces the load on the crushing mechanism. However, any other adjustment of the deflector element 33 relative to the eccentric is also conceivable. In principle, it would also be possible to adjust the position of the deflector element 33 relative to the eccentric during operation.

If a pump stroke is performed from the position shown in FIG. 7, the actuation element 110 moves to the position shown in FIG. 5. As soon as the deflector element 33 releases the rolling element 130, the spring 140 and/or a control pressure present at the fluid port 100.2 pushes the actuation element 110 back into the position shown in FIG. 6. Then the actuation element 110 is again available for a subsequent further pump stroke.

In FIGS. 8 to 12, an exemplary embodiment of the invention is shown in more detail using hydraulic circuit diagrams. For a better overview, the individual pipes are marked in the various functional positions shown in the Figures. Pressure-compensated pipes are drawn as long dashed lines. Pipes pressurized with a control pressure are drawn as thick continuous lines. Pipes pressurized with an accumulator pressure are drawn as short dashed lines. Pipes pressurized with a pump pressure are drawn as dotted lines.

Figure 8:
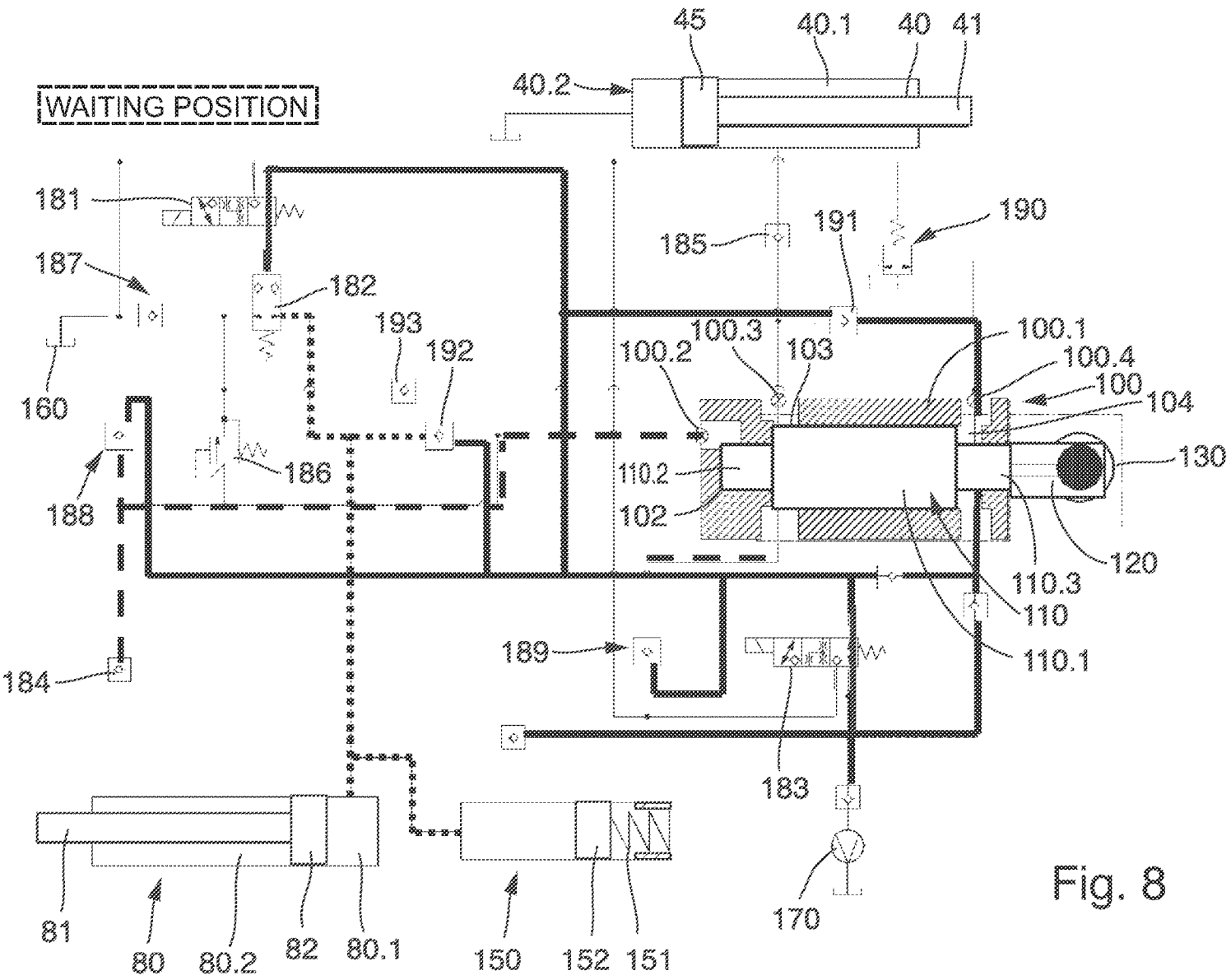

As FIG. 8 shows, the tensioning cylinder 40 and an actuator 80 are used. As mentioned above, two actuators 80 can also be used, which are then hydraulically connected in parallel. The explanations below apply to embodiments having one or two actuators 80. The actuation element 110 matches the design shown in FIGS. 5 to 7. To avoid repetition, reference is made to the explanations above. The tensioning cylinder 40 has a chamber 40.1, which is filled with hydraulic oil. The actuator 80 has a first chamber 80.1 and a second chamber 80.2, which can also be filled with hydraulic oil.

A pressure accumulator 150 is also provided. The pressure accumulator 150 is used to keep hydraulic oil pressurized. In this exemplary embodiment, a housing, in which a piston 152 is preloaded against a spring 151, can be used to form the pressure accumulator 150. The housing is used to hold hydraulic oil, which is preloaded via the piston 152 and the spring 151. The spring chamber can be atmospherically balanced or have a gas pressure.

As FIG. 8 shows, in the initial position, pressure is built up by the accumulator 150, which is the accumulator pressure in the hydraulic system. The accumulator pressure is shown as a short dashed line. As the diagram further shows, the pump chamber 104 is pressurized using a control pressure (solid, bold line). The remaining pipes, which are connected to the first pumping chamber and the second pumping chamber 102 and 103, are de-pressurized via the pilot-operated check valves 188, 189 (long dashed line). FIG. 8 shows the waiting position, which matches the position shown in FIG. 5.

Figure 9:
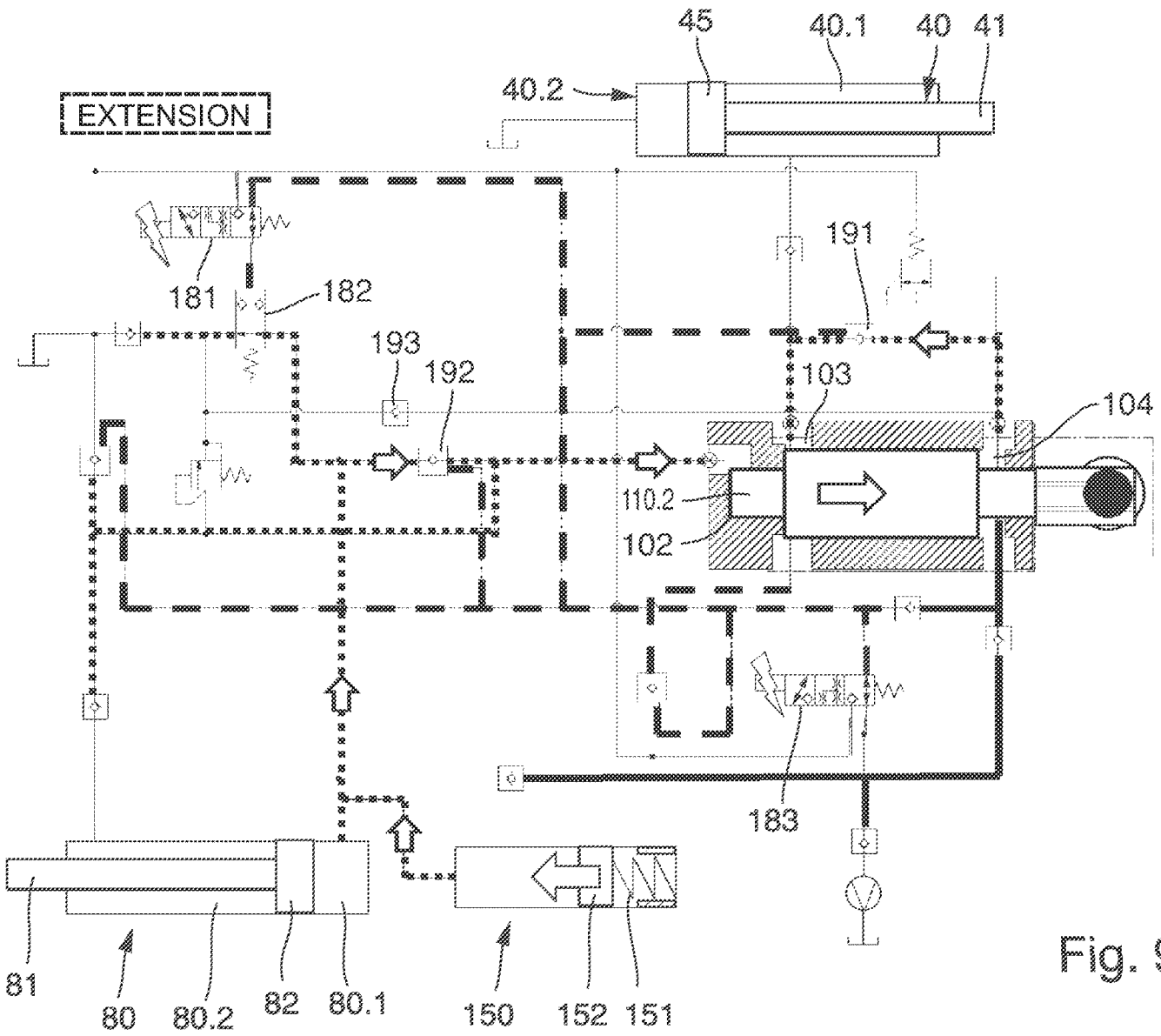

If now an overload occurs, the situation shown in FIG. 9 results. The overload is detected by the load sensor 70 and the assigned controller schematically shown in FIGS. 8-12 as 70.1. The controller 70.1 then switches the electrically switchable valves 181 and 183. As a result of this switching process, the control pressure is removed from the pump chamber 104, resulting in a transfer pressure (dotted line). Simultaneously, the valve 182 is switched such that the fluid can flow freely through the valve and the lockable check valves 191 and 192 are unlocked. Because the hydraulic blockage of the actuation element 110 has now been lifted as a result of the de-pressurization of the control pressure at the pump chamber 104, the actuation element 110 can be moved from the left to the right in the image plane as shown in FIG. 9. This adjustment motion is supported or effected by the pressure accumulator 150, which is now connected to the pump chamber 102 via the switching valve 182. Because the pump chamber is now connected to the pump chamber 103 via the unblocking of valve 191, the actuation element 110 can move from the left to the right in the image plane. The hydraulic oil, which is in the pump chamber 104, is pumped into the pump chamber 103. The hydraulic oil, which is present at the fluid port 100.2, is pumped into the pump chamber 102. In this way the actuation element 110 moves to its extended position as shown in the diagrams in FIG. 6 and FIG. 7. As mentioned above, in this position the rolling element 130 is in contact with the running surface of the cam disk, which has the deflector element 33.

Figure 10:
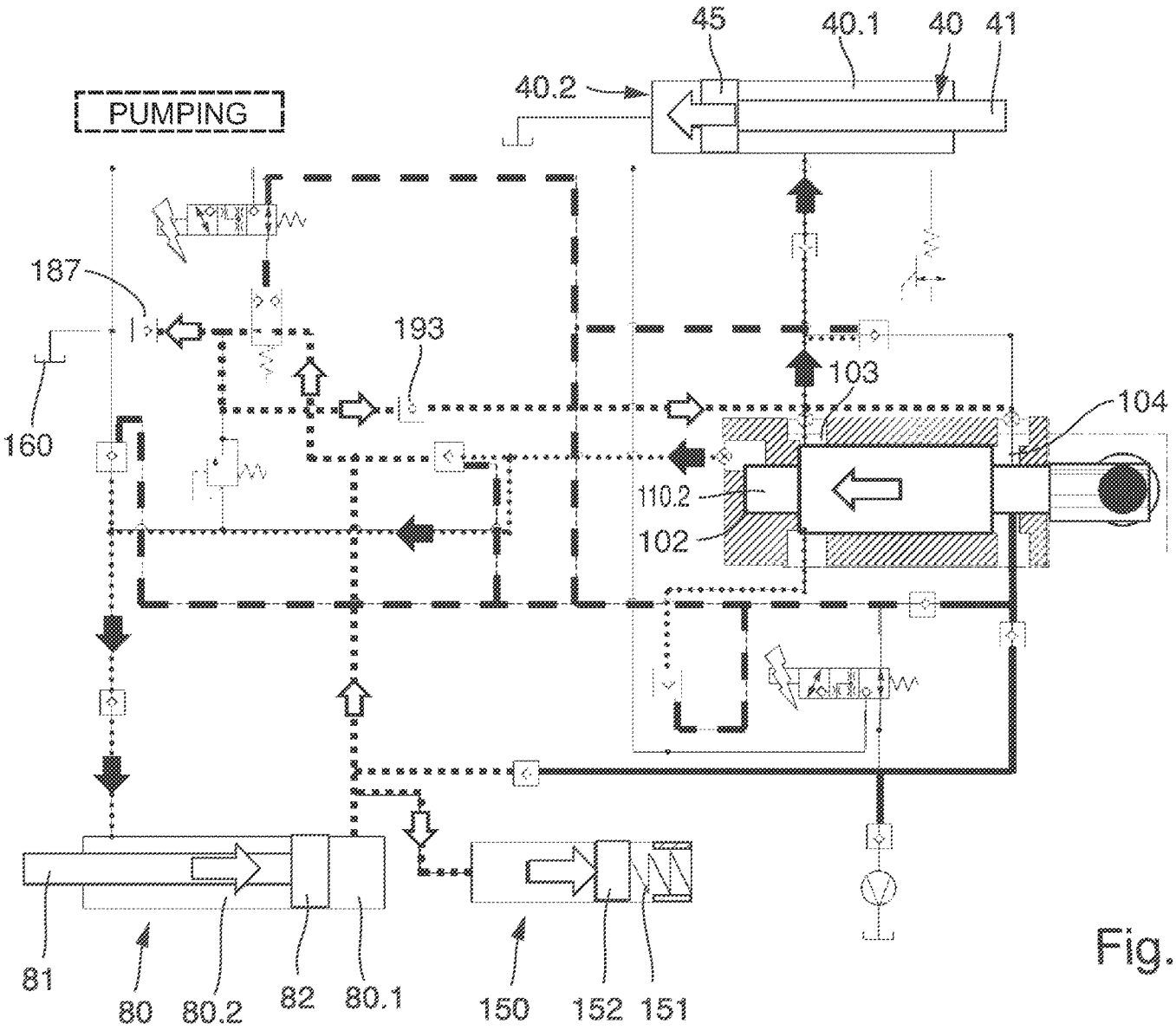

When the deflector element 33 meets the rolling element 130, the pumping motion starts, which pushes the actuation element 110 back from its extended position as shown in FIG. 6 or 7 to its retracted position as shown in FIG. 5. This is shown in FIG. 10. In so doing, pump pressures result.

Firstly, a pump pressure is generated in the pump chamber 103. The fluid port 100.3 is used to connect the pump chamber 103 to the chamber 40.1 of the tensioning cylinder 40. Accordingly, a pressure is introduced into the chamber 40.1, which acts on the piston 45 and thus activates the tensioning cylinder 40. Accordingly, the piston 45 moves the piston rod 41 (chamber 40.2 must be de-pressurized to do so). Simultaneously, the fluid port 100.2 is used to connect the first pump chamber 102 to the chamber 80.2 of the actuator 80. This pump pressure causes a displacement of the piston 82 in the actuator 80. This adjustment results in the coupling 81 being entrained from the right to the left. To prevent the actuator 80 from blocking, the chamber 80.1 on the other side of the piston 82 is de-pressurized into the pipe leading away from the accumulator 150. The hydraulic oil is thus de-pressurized into this accumulator pipe and fills the accumulator 150 until the pressure exceeds the pressure set in valve 187. Particularly preferably, the accumulator pressure at maximum filling quantity and the set pressure value of valve 187 are balanced. At the same time, the oil returning via the check valve 193 refills the front chamber 80.2, which gains volume during the pumping process. For this purpose, the actuator 80 has to have a certain area ratio or the return oil quantity of the tensioning cylinder 40 is used for this purpose.

If this process causes the pressure in the pipe to rise above a preset limit, the pressure is discharged into the tank 160 via the relief valve 187.

Figure 11:
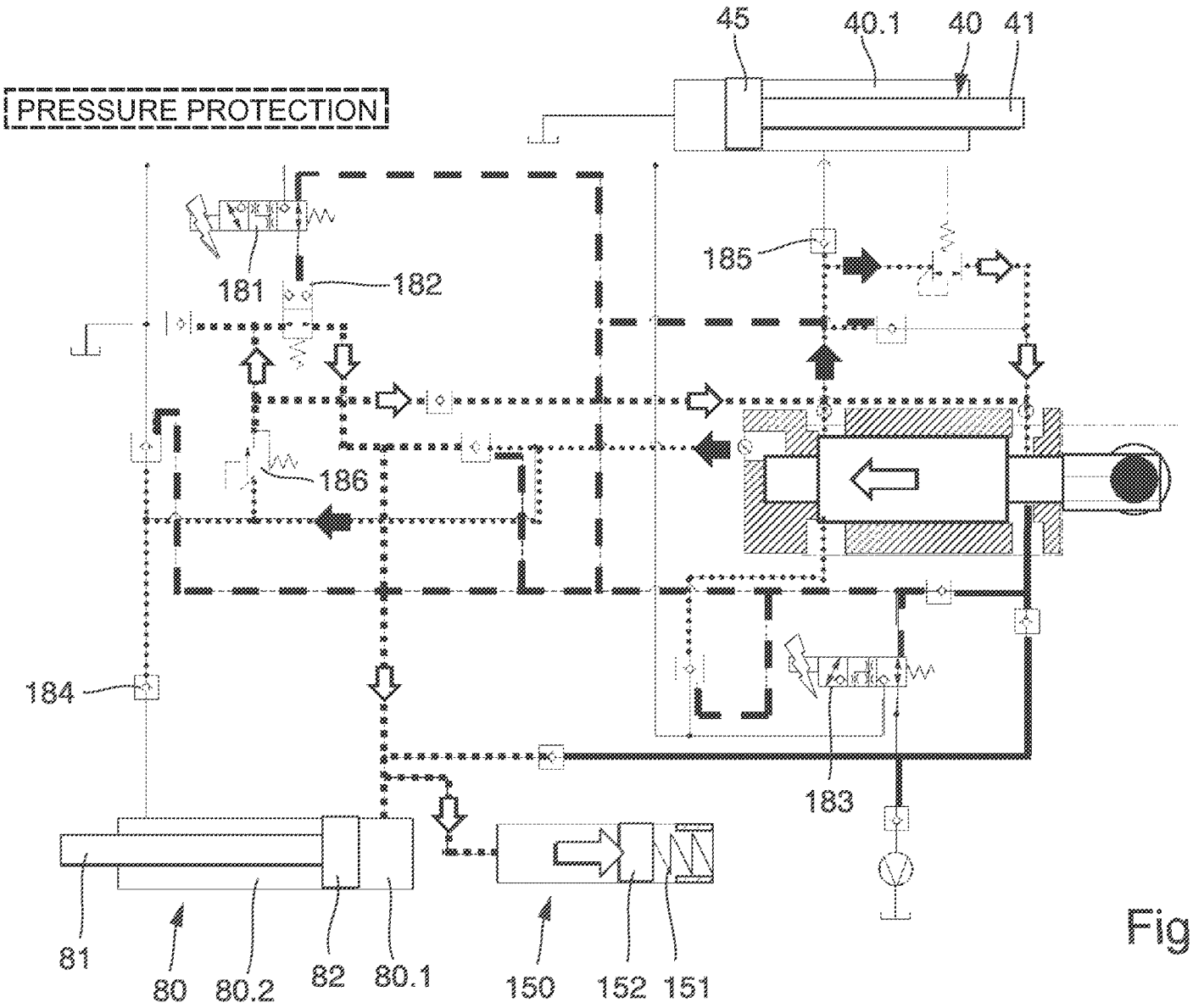

As mentioned above, the first pump stroke may be followed by a second or more pump strokes. Two unidirectional valves 184, 185 are used to secure the pressure in the tensioning cylinder 40 and in the actuator 80 after the first pump stroke (see FIG. 11). These are installed in the pipe route upstream of the chambers 40.1 or 80.2 of the tensioning cylinder 40 or of the actuator 80. As FIG. 11 shows, these unidirectionally acting valves 184, 185 block the pipe route, resulting in only the pump pressure (dotted line) being present up to these unidirectionally acting valves 184, 185. If further pump strokes are to be performed, the valves 181 and 183 are re-opened and remain open. This will again result in the situation shown in FIG. 9, wherein the actuation element 110 is extended. Then the further pumping as shown in FIG. 10 is performed and, if necessary, the pressure is maintained as shown in FIG. 11.

If the pressure rises above the value set in the valve 186, the discharged oil fills the accumulator 150. If the pressure rises above the value set in the valve 190, the oil is transferred from the chamber 103 to 104. In doing so, the oil remains in the system and is always ready for use in the next pump stroke, even after long periods at pressure limitation.

Figure 12:
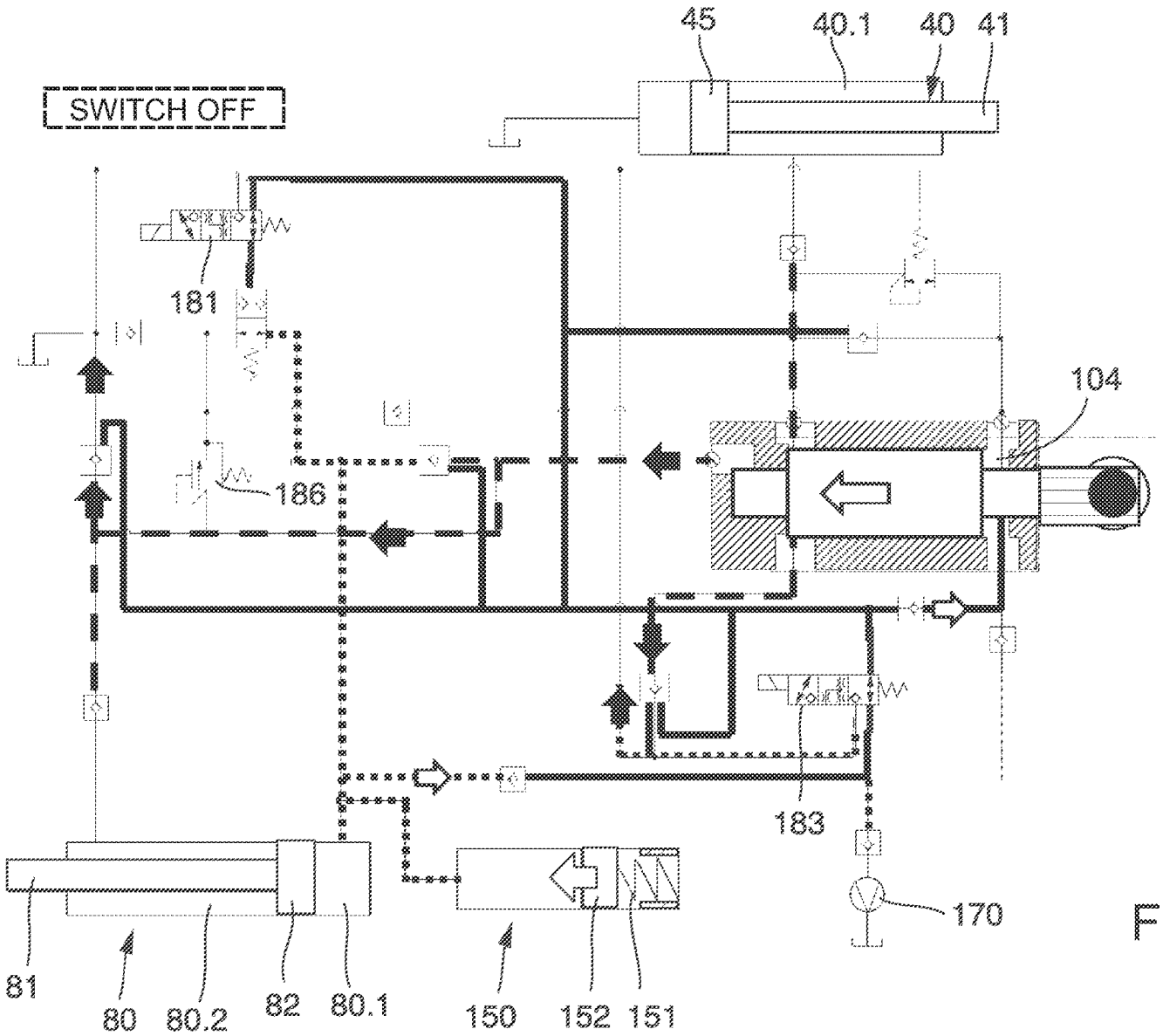

When the overload has ended, i.e. the crushing gap 24 has been opened and the uncrushable object has left the crushing chamber 23, the valves 181 and 183 are moved to their original position. In this case the actuator unit 100 is also moved back to its prepared waiting position, as shown in FIG. 8. An external pump 170 is activated for this purpose. This is shown in FIG. 12. The external pump 170 pressurizes the pump chamber 104 with an accumulator pressure. The other two pump chambers 102 and 103 are de-pressurized. In this way, the actuation element 110 is completely returned to the left to the waiting position, such that the rolling element 130 is located at a distance from the deflector element 33.

The invention claimed is:

1. A jaw crusher, comprising:

a stationary crushing jaw;

a movable crushing jaw movable relative to the stationary crushing jaw, a crushing gap being defined between the stationary crushing jaw and the movable crushing jaw;

at least one actuator configured to adjust a position of the movable crushing jaw relative to the stationary crushing jaw to increase the crushing gap when a non-crushable object enters the crushing gap, the at least one actuator including a first chamber and a second chamber;

a tensioning cylinder configured to bias the movable crushing jaw away from the stationary crushing jaw, the tensioning cylinder including a first chamber and a second chamber;

a pressure accumulator;

a high-pressure pump configured for overload protection of the crushing jaws, the high-pressure pump including a housing and a pump actuation element movably received in the housing, the pump actuation element including at least one piston;

wherein the high-pressure pump is connected in fluid-conveying manner to the at least one actuator and to the tensioning cylinder such that in a pump stroke of the pump actuation element a transfer fluid is pumped into the second chamber of the at least one actuator and the second chamber of the tensioning cylinder to increase the crushing gap; and wherein the at least one actuator and the tensioning cylinder are connected to the pressure accumulator such that a quantity of transfer fluid displaced from the first chamber of the at least one actuator and the first chamber of the tensioning cylinder during the pump stroke is temporarily stored in the pressure accumulator.

2. The jaw crusher of claim 1, wherein;

the high-pressure pump and the pressure accumulator are connected such that in a return stroke of the pump actuation element transfer fluid is supplied from the pressure accumulator to a pump chamber of the high-pressure pump.

3. The jaw crusher of claim 1, wherein;

each of the at least one actuator and the tensioning cylinder comprises a differential cylinder or a through-rod equal area cylinder.

4. The jaw crusher of claim 1, wherein;

the first chamber of the at least one actuator has a cross-sectional area at least as great as a cross-sectional area of the second chamber of the at least one actuator.

5. The jaw crusher of claim 1, wherein;

the high-pressure pump is configured such that the pump actuation element can be blocked in a rest position in which rest position the pump actuation element is ready to perform the pump stroke after the pump actuation element is released from the rest position.

6. The jaw crusher of claim 5, wherein;

the high-pressure pump includes a blocking chamber configured such that the pump actuation element is blocked in the rest position by pressurizing transfer fluid in the blocking chamber.

7. The jaw crusher of claim 5, further comprising;

a crusher drive configured to drive the jaw crusher, the crusher drive including a deflector element configured to drive the pump actuation element of the high-pressure pump; and when in the rest position of the pump actuation element there is no possible contact between the deflector element and the pump actuation element or any part attached to the pump actuation element.

8. The jaw crusher of claim 1, wherein;

the at least one piston of the pump actuation element includes a first piston and a second piston movably received in a first pump chamber and a second pump chamber, respectively, the first pump chamber includes a first fluid port configured to supply transfer fluid from the first pump chamber to the at least one actuator during the pump stroke; and the second pump chamber includes a second fluid port configured to supply transfer fluid to the tensioning cylinder during the pump stroke.

9. The jaw crusher of claim 8, wherein;

the high-pressure pump includes a blocking chamber configured such that the pump actuation element is blocked in the rest position by pressurizing transfer fluid in the blocking chamber; and the first and second pump chambers and the blocking chamber are connected to each other such that during the pump stroke the blocking chamber is supplied with a return quantity of transfer fluid from at least one of the tensioning cylinder and the at least one actuator, and such that during a return stroke the blocking chamber delivers transfer fluid to at least one of the first and second pump chambers.

10. The jaw crusher of claim 1, further comprising:

a drive shaft; and a deflector element attached to the drive shaft and configured to move the pump actuation element.

11. The jaw crusher of claim 1, wherein the high pressure pump further comprises;

a connection piece connected to the pump actuation element and extending outside of the housing; and a roller attached to the connection piece outside the housing.

12. The jaw crusher of claim 11, wherein:

the connection piece includes a receptacle;

a head is fastened in the receptacle; and the roller is mounted on the head to rotate about an axis of rotation transverse to a stroke direction of the pump actuation element.

13. The jaw crusher of claim 1, wherein:

the pressure accumulator includes an accumulator housing, an accumulator piston and a spring, the accumulator piston being movable within the accumulator housing against a preload of the spring such that the accumulator piston and the spring are configured to pressurize transfer fluid in the accumulator housing.

14. The jaw crusher of claim 1, further comprising:

a pressure plate connecting a lower part of the movable crushing jaw to a frame of the jaw crusher; and wherein the tensioning cylinder is configured to pretension the movable crushing jaw relative to the pressure plate.

15. The jaw crusher of claim 1, wherein:

the at least one piston of the pump actuation element includes first and second pistons integrally formed on the pump actuation element, the first and second pistons being coaxial to each other.

16. The jaw crusher of claim 1, wherein:

the high-pressure pump includes a blocking chamber configured such that a quantity of pressurized transfer fluid in the blocking chamber prevents any motion of the pump actuation element.

17. The jaw crusher of claim 1, wherein:

the at least one piston of the pump actuation element includes first and second active sides arranged opposite from one another, the first and second active sides being in communication with first and second pump chambers, respectively.

18. The jaw crusher of claim 1, wherein:

the at least one piston of the pump actuation element includes a first piston and a second piston movably received in a first pump chamber and a second pump chamber, respectively; and the first and second pistons are configured such that during the pump stroke different volumes of transfer fluid are delivered from the first and second pump chambers.

19. The jaw crusher of claim 1, wherein:

the at least one piston of the pump actuation element includes a first piston and a second piston movably received in a first pump chamber and a second pump chamber, respectively; and the first and second pistons are configured such that during the pump stroke different pressures are generated in the first and second pump chambers.

* * * * *